United States Patent [19]

Hohne et al.

[11] 4,251,023

[45] Feb. 17, 1981

[54] CENTRIFUGE WITH HORIZONTALLY JOURNALLED ROTOR

[75] Inventors: Per Hohne, Valby-Kobenhavn, Denmark; Andreas Kontarinis, Sodertalje, Sweden; Siegfried Titel, Neu Börnsen, Fed. Rep. of Germany

[73] Assignee: Alfa-Laval Separation A/S, Soborg, Denmark

[21] Appl. No.: 1,756

[22] Filed: Jan. 8, 1979

[30] Foreign Application Priority Data

Jan. 12, 1978 [SE] Sweden ..... 7800348

[51] Int. Cl.[3] ..... B04B 15/00

[52] U.S. Cl. ..... 233/1 R

[58] Field of Search ..... 233/1 R, 1 A, 1 B, 1 C, 233/7, 14 R, 27; 248/671, 672, 637, 638; 210/380 H, 398; 181/200

[56] References Cited

U.S. PATENT DOCUMENTS

| | | | |
|---|---|---|---|
| 3,221,879 | 12/1965 | Irving | 210/380 H |
| 3,744,711 | 7/1973 | Smith | 233/1 B |
| 3,901,349 | 8/1975 | DeNoyer | 181/200 |
| 4,110,876 | 9/1978 | Weiss et al. | 181/200 X |

OTHER PUBLICATIONS

Bird Machine Co. Publication, Nov. 1947, p. 3.

*Primary Examiner*—George H. Krizmanich
*Attorney, Agent, or Firm*—Cyrus S. Hapgood

[57] ABSTRACT

A horizontally journalled centrifugal rotor has support bearings at its opposite end portions resting on the bottoms of notches in respective end wall elements of a frame which also includes longitudinal elements extending on each side of the rotor and fixing the end wall elements relative to each other along their entire side edges, the support bearings having flanges parallel with the end wall elements and coacting therewith to fix the support bearings against endwise movement relative to the frame. The upper edges of the end wall elements, the longitudinal elements and the bearing flanges form together an endless contact surface disposed in a single plane and in sealing engagement with a similar contact surface of a top cover for the frame.

6 Claims, 3 Drawing Figures

CENTRIFUGE WITH HORIZONTALLY JOURNALLED ROTOR

The present invention relates to a centrifugal separator with a horizontally journalled rotor, primarily a so-called decanter centrifuge having inside the rotor and coaxially therewith a conveying screw for discharging the separated sludge. More specifically, the invention relates to a new construction of the rotor support frame and other static elements, which together with the support frame define the outside casing of the separator, thereby providing a decanter centrifuge which, compared to a conventional decanter centrifuge, better meets modern environmental criteria such as low noise level, security against leakage and low injury risk.

The noise problems and the sealing problems in a conventional decanter centrifuge are intimately associated with the design of the support frame and rotor cover of the separator. The support frame, in which the rotor is journalled, generally consists of a low, sturdy frame upon which two supporting bearings are mounted resting on plane horizontal surfaces. The upper part of the rotor is covered by the rotor cover, the end walls of which have notches receiving the rotor journals inside the two supporting bearings, leaving the latter relatively unscreened and exposed to the surroundings in respect of bearing sound emission. With this arrangement, it is almost unavoidable that open slots are formed between the cover end walls and the journals rotating in the notches of the end walls, and consequently sound-generating air streams and leakage of possible polluting gases from inside the centrifuge cannot be effectively prevented. Another disadvantage is associated with the low frame design combined with the high rotor shaft montage, making heavy demands on the levelness of the centrifuge foundation and careful finishing of those frame surfaces in supporting contact with the bearings at the place of application where the frame and rotor unit are supplied as separate packing units.

The principal object of the present invention is to provide a support frame and outside casing for the moving parts of the decanter centrifuge whereby the above-noted disadvantages as to noise level, leakage and transportation and installation problems are reduced. According to the invention, this object is attained with a centrifuge construction characterized in that the rotor support bearings are submerged in notches in the end wall elements into supporting contact with the bottoms of said notches and fixed to the end wall elements by means of bearing flanges extending essentially in parallel with the end wall elements.

The invention makes it possible to achieve an effective sealing between the frame, in which the centrifuge rotor is journalled, and the lid or top cover of the frame. This can be achieved by so arranging the upper borders of the frame wall elements, the frame longitudinal elements and the bearing flanges that they define an endless contact surface disposed in a single plane. Along this plane contact surface, complete sealing can be attained by means of a sealing strip of elastic material, making any finishing of the contact surfaces of the frame and the top cover completely unnecessary. These plane contact surfaces, in combination with frame walls which are continuous from the bottom up to the top cover, provide a completely closed external supporting casing which, compared to earlier designs, gives a considerably improved sealing against gas flow from inside the centrifuge to the surroundings.

The centrifugal separator according to the invention considerably reduces the noise level. Firstly, the completely closed frame design effects a reduction of the noise caused by air streaming along the rotor. Secondly, the bearing sounds are essentially reduced due to the bearing montage in the completely closed casing. Vibrations of audible frequencies from the bearings mounted in the frame end walls, being "canalized" or transmitted in the frame walls, can be deadened simply and effectively by providing the frame walls and top cover with a sound deadening coating or by making those parts of a sound-deadening material such as a steel plate laminate consisting of two steel plates with an intermediate layer of plastic material.

The relatively high continuous side walls of the frame according to the invention provide a very strong stabilization of the bearing supporting end wall elements with respect to each other. This rigidity of the frame provides several advantages. Thus, the decanter can be mounted on only three supports, so that no special demands on the levelness of the foundation for the decanter are needed. Also, the supports can consist of very soft oscillation dampers. Dampers absorbing the dynamic load to be less than 10% of the static load at the normal rotor speed can doubtless be used. In a preferred embodiment of the invention, dampers are used giving a dynamic load less than 5%. Further, the rigid frame design allows transportation of the decanter completely assembled, the packing being reduced to a minimum. The decanter is then provided with additional suspension devices for the rotor to prevent bearing damages. At the place of installation, no special adjusting of the supporting bearing surfaces is needed. Also, one rotor mounted in the frame can be directly replaced by another rotor, which facilitates the serial production of support frame and rotor.

The invention will now be further described with reference to the embodiment illustrated on the accompanying drawings, in which.

Figure 1:
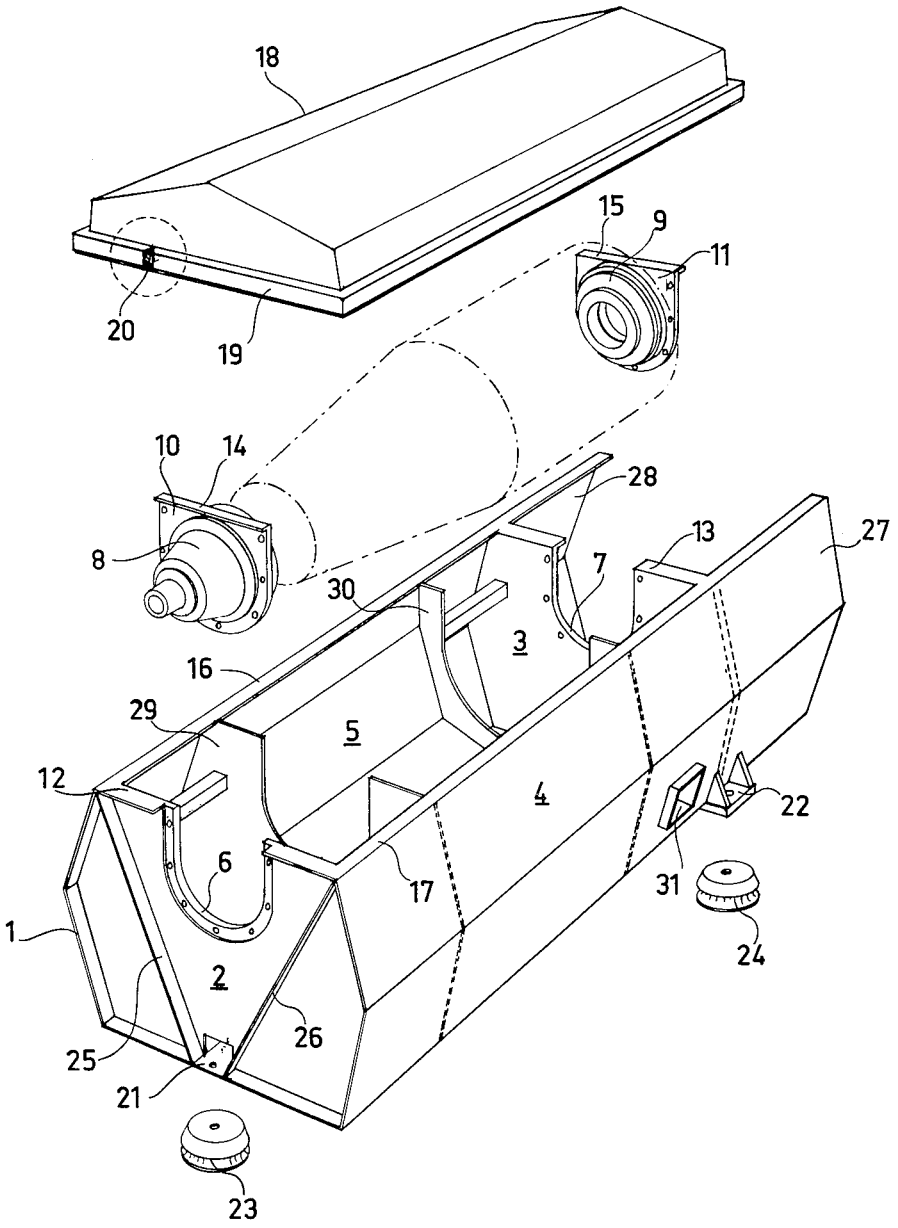
FIG. 1 is an exploded perspective view of the decanter centrifuge including (starting from the top) a top cover, a rotor provided with two support bearings, a frame and three oscillation damping supports.

Referring to the drawings, a frame 1 comprises two strong end wall elements 2 and 3, which are fixed with respect to each other along the entire side edges by means of two longitudinal elements 4 and 5 located on each side of the rotor. All these elements 2–5 consist of plates. In a centain embodiment, the longitudinal elements 4 and 5 can consist of plates having a thickness of 6 mm, the end wall plates 2 and 3 having a thickness of 40 mm.

Figure 2:
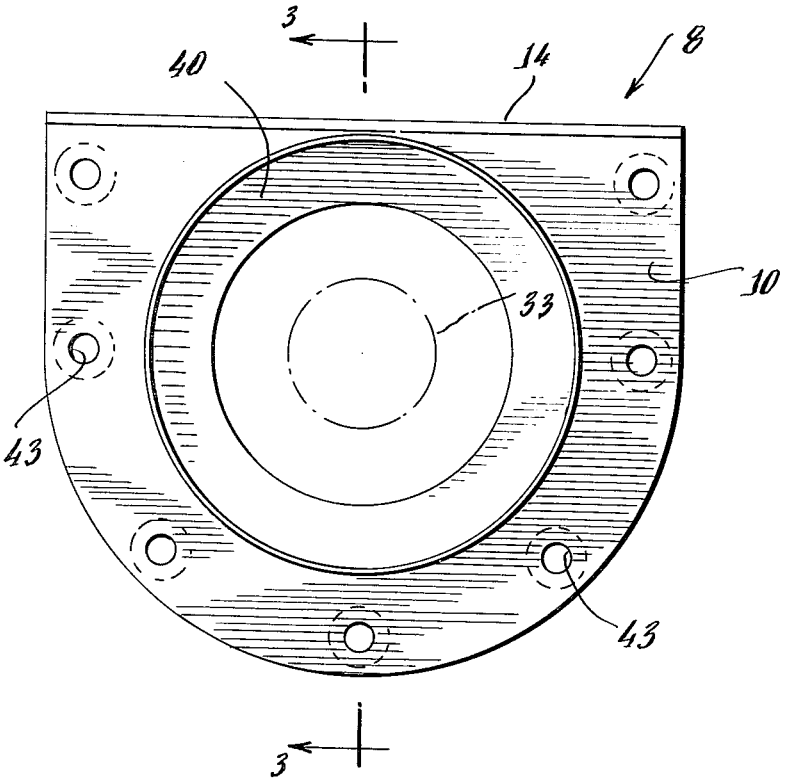
FIG. 2 is an enlarged front elevational view of parts of one of the support bearings shown in FIG. 1.
Figure 3:
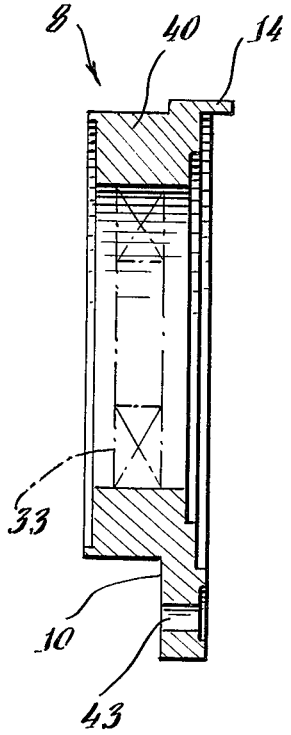
FIG. 3 is a sectional view on line III—III in FIG. 2.

In the upper portion of the end wall plates 2 and 3 are notches, the bottoms of which form half-circular contact surfaces 6 and 7 for two support bearings 8 and 9 of the rotor. The support bearings 8 and 9 are provided with flanges 10 and 11 having contact surfaces in parallel with the end wall elements for fixing the bearings to the end wall elements 2 and 3. More particularly, in each support bearing the inner bearing ring of a conventional standard bearing 33 (ball or roller bearing) is fixed to the centrifuge rotor shaft, the outer bearing ring being fixed to a special bearing housing. The bearing housing of support bearing 8 consists of a circular-cylindrical member 40 (FIGS. 2 and 3) encircling the outer bearing ring with careful fit, and the radially directed flange 10 firmly joined with the circular-cylindrical member. It is said circular-cylindrical member 40 of the bearing housing which rests upon the bottom of the corresponding notch of one of the end wall elements 2 and 3. Each pair of corresponding half-circular contact surfaces of the end wall element notches and the bearing housings are carefully designed and adjusted to each other. While the flanges 10 and 11 and bolts (not shown) are passing through holes 43 means for fixing the support bearing housings in axial and vertical direction with respect to the end wall elements 2 and 3, other relative movements between the bearing housings and the end wall elements 2 and 3 are counteracted by the careful fit between the circular-cylindrical members of the bearing housings and the notches in the end wall elements.

The top edges 12 and 13 of the end wall elements 2 and 3 define together with the top edges 14 and 15 of the bearing flanges 10 and 11, and with the top edges 16 and 17 of the longitudinal elements 4 and 5, a continuous surface located in a single plane for contacting the corresponding surface of a lid or top cover 18.

Fixed around the cover 18 is a border frame 19 which opens downwardly and contains an endless sealing strip 20 (shown in the drawing in section within a dashed circle).

The frame 1 is provided at the bottom with three support plates to be fixed to three corresponding oscillation dampers, one support plate 21 being fixed directly below the rotor shaft to the end wall element 2 which supports the lighter end of the rotor. The other two support plates are symmetrically located on each side of the rotor shaft and fixed at the bottom of the end wall element 3 supporting the heavier rotor end. In the drawing, only one of these two other support plates is shown, designated by the reference numeral 22. The oscillation dampers corresponding to the support plates 21 and 22 are designated by the reference numerals 23 and 24, respectively.

The end wall element 2 is further strengthened by reinforcement elements 25 and 26 extending from the two upper corners of the side wall element diagonally down towards the support plate 21. The opposite end wall element 3 is likewise provided with further reinforcement elements (not shown).

The longitudinal side elements 4 and 5 continue in the side walls 27 and 28 beyond the rear end wall element 3. These side walls 27 and 28, together with a separate lid and a further end wall element (not shown), define a closed casing for the bear box and the transmission wheel for driving the rotor and conveying screw.

Inside the outer casing defined by the top cover 18 and the frame 1, the rotor is suitably surrounded by a thinner casing (not shown), which can be made of stainless steel or, if required for a certain application, of a still more noble material, so that the supporting frame and the top cover do not need to be made of such a noble material. The inner casing is divided into three sections, as indicated by the two intermediate walls 29 and 30. These coact with the jacket plate, which is fixed at the upper part of each of the two longitudinal elements 4 and 5, to form a trough around the rotor, said trough normally serving as a water collector during cleaning operations. In the rear section between the wall 30 and the end wall element 3, where the outlet openings in the rotor for purified liquid are located, a closed liquid discharge housing is suitably arranged around the rotor, said housing continuing into a channel 31 which penetrates the frame wall 4 through an opening therein. Likewise, in the section in front of the wall 29, where the sludge discharge from the rotor occurs, a similar closed sludge discharge housing can be arranged around the rotor, and from the bottom of said housing the sludge can be conveyed out through one of the frame walls 4 or 5 by means such as a screw conveyor.

By means of the inner plate casing described above, the supporting outer casing can be kept completely screened from the medium to be separated, which might have a very high temperature (e.g., 100° C.). Therefore, the injury hazard due to possible contact with hot surfaces is eliminated. Also, the injury hazard due to breaks in the rotating elements is considerably reduced in the decanter according to the invention, since the rotating elements are completely enveloped by the very strong support frame.

We claim:

1. In a centrifugal separator, the combination of a horizontally journalled centrifugal rotor having support bearings at opposite end portions thereof, and a frame including two end wall elements supporting said support bearings, respectively, the frame also including longitudinal elements extending on each side of the rotor and fixing the end wall elements relative to each other along their entire side edges, said end wall elements having upwardly opening notches, said support bearings being substantially completely submerged in said notches and having supporting contact with the bottoms of said notches, said support bearings having flanges parallel with the end wall elements and coacting therewith to fix the support bearings against endwise movement relative to the frame, the bottoms of the notches in the end wall elements having the form of a half-circle, each support bearing including a circular-cylindrical part resting on the bottom of the notch in the corresponding end wall element, each said flange being firmly joined to a said circular-cylindrical part.

2. The combination of claim 1, in which each end wall element forms with the corresponding support bearing a continuous end wall having a straight continuous upper border.

3. The combination of claim 1, comprising also oscillation damping supports fixed to and supporting the frame, said damping supports having sufficient oscillation damping capacity to reduce the dynamic load on a foundation under said damping supports, at full rotor speed, to less than 10% of the static load exerted by the centrifugal separator on the foundation.

4. The combination of claim 1, comprising also only three oscillation damping supports fixed to and supporting the frame.

5. The combination of claim 2, in which said longitudinal elements of the frame have upper surfaces merging with said upper borders of the end wall elements, said upper surfaces and upper borders forming an endless surface disposed in a single plane.

6. In a centrifugal separator, the combination of a horizontally journalled centrifugal rotor having support bearings at opposite end portions thereof, and a frame including two end wall elements supporting said support bearings, respectively, the frame also including longitudinal elements extending on each side of the rotor and fixing the end wall elements relative to each other along their entire side edges, said end wall elements having notches, said support bearings being submerged in said notches and having supporting contact with the bottoms of said notches, said support bearings having flanges parallel with the end wall elements and coacting therewith to fix the support bearings against endwise movement relative to the frame, the upper edges of the end wall elements, the longitudinal elements and the bearing flanges cooperating to form a first endless contact surface disposed in a single plane, the combination comprising also a top cover having a second endless contact surface disposed in a single plane and in sealing engagement with said first contact surface.

* * * * *